US005839346A

United States Patent [19]

Sekiya et al.

[11] Patent Number: 5,839,346

[45] Date of Patent: Nov. 24, 1998

[54] ROTARY HYDRAULIC ACTUATOR INCLUDING GROOVE-LIKE FLUID SUPPLY PATHS IN A FACE OF A BRACKET

[75] Inventors: Mutsuo Sekiya, Tokyo; Katsuyuki Fukuhara, Kobe; Masafumi Sugawara, Tokyo, all of Japan

[73] Assignee: Mitsubishi Denki Kabushiki Kaisha, Tokyo, Japan

[21] Appl. No.: 840,759

[22] Filed: Apr. 16, 1997

[30] Foreign Application Priority Data

Oct. 8, 1996 [JP] Japan ..... 8-267603

[51] Int. Cl.[6] ..... F01B 25/26

[52] U.S. Cl. ..... 92/5 R; 92/125; 92/164; 91/462

[58] Field of Search ..... 92/120, 121, 122, 92/123, 124, 125, 31, 32, 5 R, 164; 91/418, 462

[56] References Cited

U.S. PATENT DOCUMENTS

| | | | |
|---|---|---|---|
| 4,099,450 | 7/1978 | Mase | 91/403 |
| 4,177,713 | 12/1979 | Lewis et al. | 91/375 R |
| 4,882,977 | 11/1989 | Himeno et al. | 92/5 R |
| 4,889,035 | 12/1989 | Goodnow | 91/275 |
| 5,228,289 | 7/1993 | Norton | 60/486 |

FOREIGN PATENT DOCUMENTS

| | | |
|---|---|---|
| A-7-238815 | 12/1995 | Japan . |
| A-7-259516 | 10/1996 | Japan . |

*Primary Examiner*—Thomas E. Denion

*Attorney, Agent, or Firm*—Sughrue, Mion, Zinn, Macpeak & Seas, PLLC

[57] ABSTRACT

A rotary hydraulic actuator including a sealed vessel including brackets and a casing, a partition vane attached to a shaft supported by the brackets for dividing an inside of the sealed vessel into a first pressure chamber and a second pressure chamber and pivoting the shaft by a pressure difference between the first and the second pressure chambers, suction and exhaust hydraulic ports and a drain port installed to the casing, a hydraulic control valve mounted to the casing for conducting a hydraulic control along with the suction and exhaust hydraulic ports and the drain port, groove-like hydraulic pressure supply paths installed to a face of one of the brackets in contact with the casing for communicating the first pressure chamber and the second pressure chamber respectively to the suction and exhaust hydraulic ports and a groove-like drain path installed to a face of other one of the brackets in contact with the casing for communicating to the drain port.

13 Claims, 10 Drawing Sheets

ROTARY HYDRAULIC ACTUATOR INCLUDING GROOVE-LIKE FLUID SUPPLY PATHS IN A FACE OF A BRACKET

BACKGROUND OF THE INVENTION

1. Field of the Invention

The present invention relates to a rotary hydraulic actuator suitable for controlling timings in opening and closing suction and exhaust valves of an internal combustion engine.

2. Discussion of the Background

FIG. 18 and FIG. 19 are sectional views for explaining the outline structure and the operation of a conventional rotary hydraulic actuator wherein FIG. 18 is a longitudinal sectional view orthogonal to a shaft of the actuator and FIG. 19 is a cross-sectional view thereof. In FIG. 18 and FIG. 19, numeral 1 designates a chamber comprising a casing 1*a*, a drive side bracket 1*b* and a rear bracket 1*c*, numeral 2 designates an output shaft pivotably supported by the both brackets 1*b* and 1*c* via bearings 13, numeral 3 designates a rotor constituted integrally with the output shaft 2, numeral 4 designates a partition vane being pivoted such that an outer face thereof is moved abrasively on an inner face of the casing 1*a* and both end faces thereof are moved abrasively on inner faces of the both brackets 1*b* and 1*c*, wherein a sealed pressure vessel constituted by the inner faces of the casing 1*a* and both brackets 1*b* and 1*c*, is divided into a first pressure chamber 5 and a second pressure chamber 6 by the partition vane 4. Numeral 7 designates an oil suction and exhaust path of the first pressure chamber 5 and numeral 8 designates an oil suction and exhaust path of the second pressure chamber 6 and these paths are connected to an electromagnetic type hydraulic pressure control valve 9 for switching 4 ports and 3 positions by pipings. Notations 9*a*, 9*b*, 9*c* and 9*d* designate the ports of the hydraulic pressure control valve 9, where the port 9*a* is connected to a hydraulic pump 10, the port 9*b* is connected to the oil suction and exhaust path 7 of the first pressure chamber 5, the port 9*c* is connected to the oil suction and exhaust path 8 of the second pressure chamber 6, respectively via pipes and the port 9*d* is connected to an oil tank 11 via a return pipe 12. Incidentally, numeral 14 designates an oil seal.

According to the conventional rotary hydraulic actuator constituted as described above, when the electromagnetic type hydraulic pressure control valve 9 is operated, the ports 9*a* and 9*b* are communicated and the ports 9*c* and 9*d* are communicated respectively with each other, the oil from the hydraulic pump 10 is made to flow to the first chamber 5 via the hydraulic suction and exhaust path 7, the oil in the second pressure chamber 6 is exhausted to the oil tank 11 via the return pipe 12, the partition vane 4 is pushed in a bold line arrow mark direction of FIG. 18 by a difference in pressures applied on the both faces thereof and operates a cam shaft of an internal combustion engine, not illustrated, by being pivoted in the anti-clockwise direction along with the output shaft 2. Further, when the hydraulic pressure control valve 9 communicates the ports 9*a* and 9*c* and communicates the ports 9*b* and 9*d*, the oil from the hydraulic pump 10 is supplied to the second pressure chamber 6 via the oil suction and exhaust path 8, the oil in the first pressure chamber 5 is exhausted to the oil tank 11 via the return pipe 12 and as a result, the partition valve 4 is pushed in a dotted line arrow mark direction of FIG. 18 and operates the cam shaft of the internal combustion engine by being pivoted in the clockwise direction along with the output shaft 2. Further, when both of the ports 9*b* and 9*c* of the hydraulic control valve 9 are closed, the pressures of the first pressure chamber 5 and the second pressure chamber 6 are equally held, the output shaft 2 stops pivoting and the position thereof is held.

As described above, according to the conventional rotary hydraulic actuator, the rotational position of the output shaft 2 can be controlled and the output shaft 2 can be stopped and held at an arbitrary rotational position by using the valve 9. However, hydraulic pipings are needed to install between the main body of the actuator and the hydraulic pressure control valve 9, which necessitates a complicated operation in integrating it to an internal combustion engine. In contrast thereto, according to, for example, Japanese Unexamined Patent Publication No. JP-A-7-238815, a rotary hydraulic actuator where a rotary valve is integrally installed in the axial direction of an output shaft of an actuator, has been disclosed. According to the conventional actuator of a hydraulic pressure control valve integrated type, hydraulic pipings are simplified, however, magnification of device is unavoidable and if a feedback control is conducted by using a rotational angle sensor, there is restriction in the position of attaching the rotational angle sensor thereby causing a problem in the mountability in respect of an internal combustion engine.

Further, a hydraulic actuator for driving a cam shaft of an internal combustion engine requires considerable drive force and good response. According to the above-described rotary hydraulic actuator, the drive force is determined by the area of the partition vane 4, that is, the inner volumes of the respective pressure chambers 5 and 6 and the hydraulic pressure applied on the pressure chambers. Large volume of the pressure chambers amounts to magnification of the device and deterioration of the response. To make compatible the drive force and the response with each other in using a small-sized device, it is necessary to enhance further the hydraulic pressure or to reduce loss caused at the inside of the hydraulic actuator. As factors of the inner loss, leakage of oil due to a pressure difference between the first pressure chamber 5 and the second pressure chamber 6 and an increase in abrasive resistance caused by decreasing a clearance between the partition vane 4 and the inner face of the chamber 1 that is conducted for restraining oil leakage, are pointed out. However, the reductions of the both losses are difficult to be compatible with each other.

Furthermore, according to the rotary hydraulic actuator of this kind, the oil leakage between the ports of the hydraulic control valve 9 is unavoidable in non-operating the valve. The inner pressures of the respective pressure chambers 5 and 6 are lowered by the oil leakage and the holding power in respect of the partition vane 4 is lowered. As a result, the initial position of the output shaft 2 is varied by external causes such as vibration or the like whereby the positional accuracy of the valve in reusing it may not be maintained.

SUMMARY OF THE INVENTION

The present invention has been carried out in order to resolve the above-described problems and it is an object of the present invention to provide a rotary hydraulic actuator having sufficient drive force and response even with a small-sized structure, capable of holding the initial position in non-operating the device and having excellent mountability.

According to a first aspect of the present invention, there is provided a rotary hydraulic actuator comprising a sealed vessel comprising brackets and a casing, a partition vane attached to a shaft supported by the brackets for dividing an inside of the sealed vessel into a first pressure chamber and a second pressure chamber and pivoting the shaft by a pressure difference between the first and the second pressure chambers, suction and exhaust hydraulic ports and a drain port installed to the casing, a hydraulic control valve mounted to the casing for conducting a hydraulic control along with the suction and exhaust hydraulic ports and the drain port, groove-like hydraulic pressure supply paths installed to a face of one of the brackets in contact with the casing for communicating the first pressure chamber and the second pressure chamber respectively to the suction and exhaust hydraulic ports and a groove-like drain path installed to a face of other one of the brackets in contact with the casing for communicating to the drain port.

According to a second aspect thereof, there is provided the rotary hydraulic actuator according to the first aspect, wherein a load is connected to one end portion of the shaft and a rotational position detecting sensor is installed to other end portion.

According to a third aspect thereof, there is provided the rotary hydraulic actuator according to the first or the second aspect, wherein the hydraulic supply paths and the drain path are separately installed to different ones of the faces of the brackets in contact with the casing.

According to a fourth aspect thereof, there is provided the rotary hydraulic actuator according to the first or the second aspect, wherein both of the hydraulic pressure supply paths and the drain path are installed to one of the faces of the brackets in contact with the casing.

According to a fifth aspect thereof, there is provided the rotary hydraulic actuator according to any one of the first through the fourth aspect, wherein the partition vane is provided with a groove installed to an abrasive movement face thereof in respect of an inner face of the sealed vessel and a seal member in a netted string shape impregnated with a Teflon group resin, is mounted onto the groove.

According to a sixth aspect thereof, there is provided the rotary hydraulic actuator according to any one of the first through the fourth aspect, wherein the partition vane is provided with an abrasive movement portion in respect of an inner face of the sealed vessel comprising a seal member impregnated with a Teflon group resin and hard fixed plates pinching the abrasive movement portion from side faces thereof.

According to a seventh aspect thereof, there is provided the rotary hydraulic actuator according to any one of the first through the fourth aspect, wherein the partition vane is provided with an abrasive movement portion in respect of an inner face of the sealed vessel covered by a seal member in a bag-like shape formed by fluorinated rubber or a Teflon group resin.

According to an eighth aspect thereof, there is provided the rotary hydraulic actuator according to any one of the first through the fourth aspect, wherein the partition vane is provided with an abrasive movement face in respect of an inner face of the sealed vessel covered by fluorinated rubber or a Teflon group resin by an insert molding of a main body of the partition vane.

According to a ninth aspect thereof, there is provided the rotary hydraulic actuator according to the seventh or the eighth aspect, wherein the partition vane is provided with protruded portions in a skirt-like shape made of fluorinated rubber or a Teflon group resin which are protruded from both side corner portions of the abrasive movement face in respect of the inner face of the sealed vessel into the first and the second pressure chambers.

According to a tenth aspect thereof, there is provided the rotary hydraulic actuator according to any one of the first through the ninth aspect, wherein the partition vane is held at an initial position by a ball stopper installed to a fixed portion.

According to an eleventh aspect thereof, there is provided the rotary hydraulic actuator according to any one of the first through the ninth aspect, wherein a motion of the partition vane is regulated by a lock mechanism operating in correspondence with an operational state of the hydraulic control valve.

According to a twelfth aspect thereof, there is provided the rotary hydraulic actuator according to any one of the first through the eleventh aspect, wherein the shaft is provided with a rotational position restoring mechanism having a spring-like member.

EMBODIMENT 1

Figure 1:
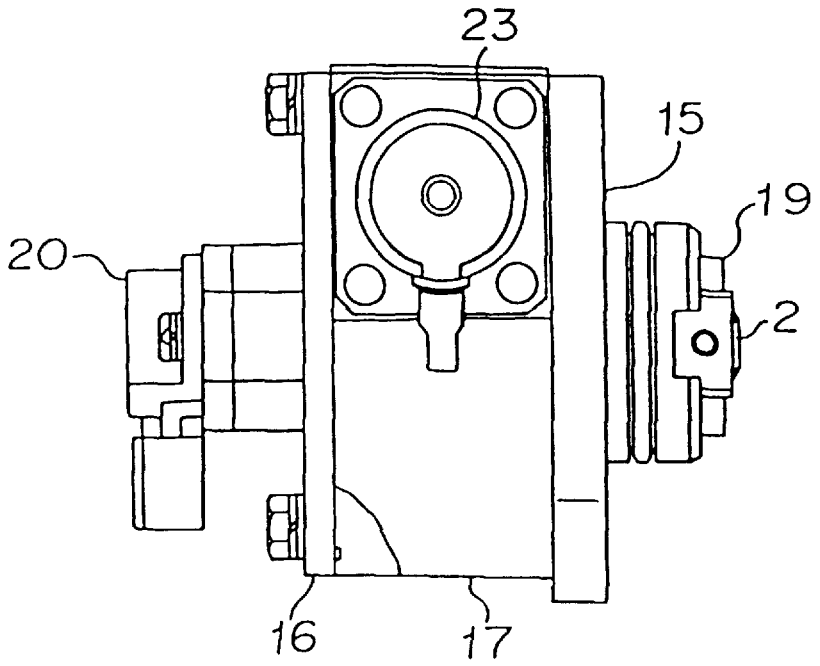
FIG. 1 is a side view of a first embodiment of the present invention.
Figure 2:
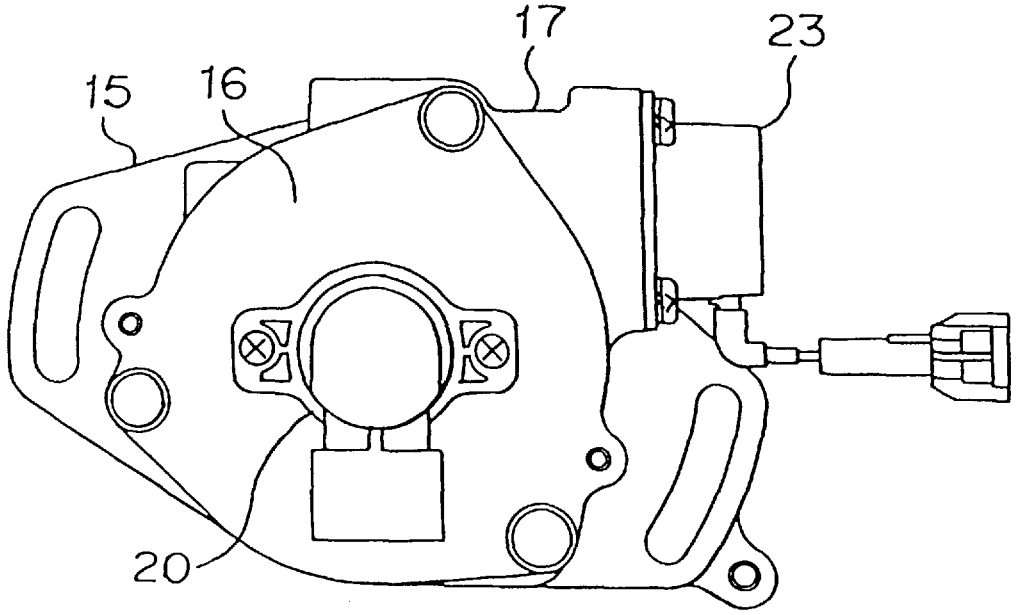
FIG. 2 is a plane view of the first embodiment of the present invention.
Figure 3:
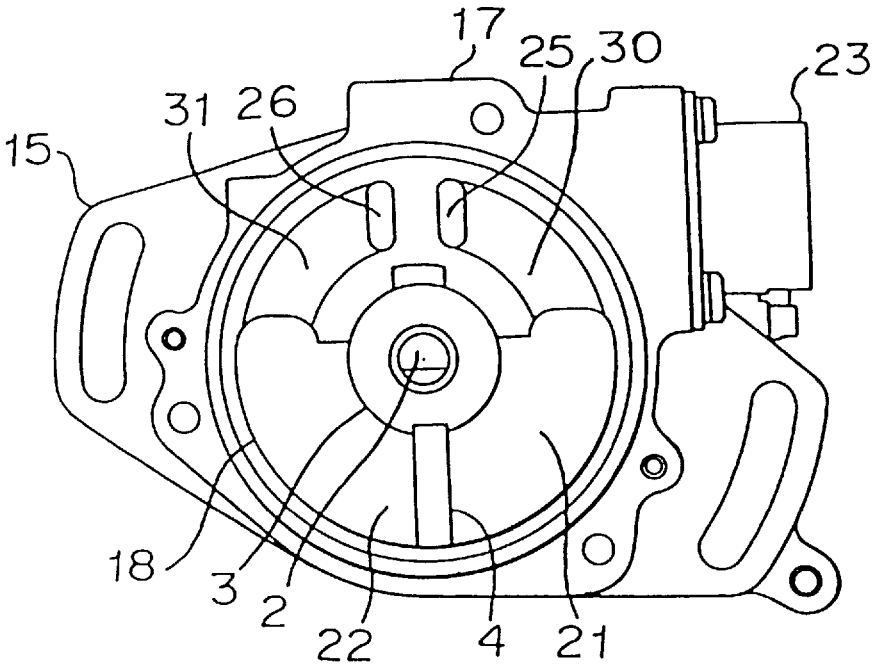
FIG. 3 is a plane view showing an inner portion of the first embodiment of the present invention.
Figure 4:
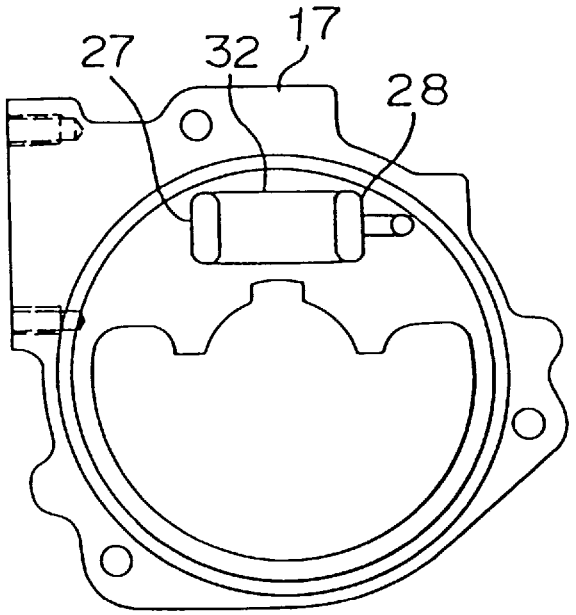
FIG. 4 is a plane view showing the inner portion of the first embodiment of the present invention.
Figure 5:
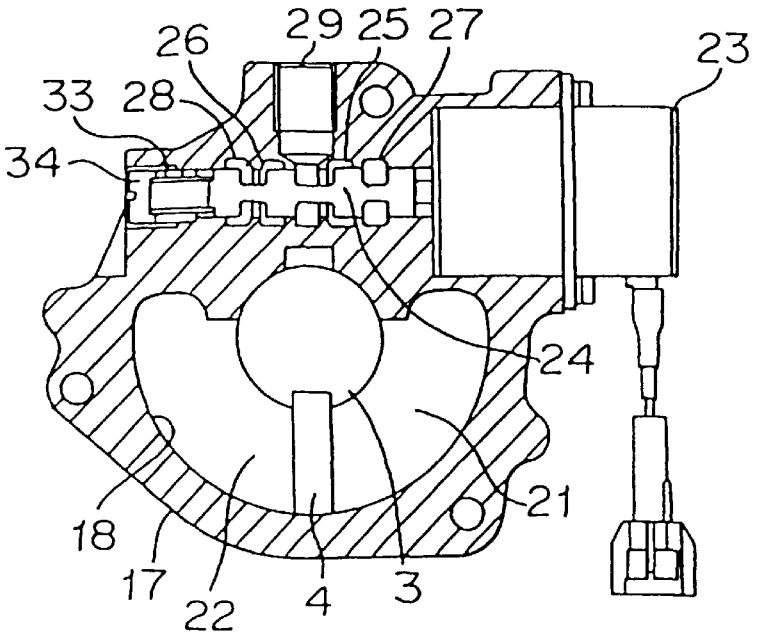
FIG. 5 is a sectional view showing a valve mechanism of the first embodiment of the present invention.

FIG. 1 through FIG. 5 illustrate the constitution of Embodiment 1 of the present invention where FIG. 1 is a side view of a rotary hydraulic actuator, FIG. 2 is a plane view in view from the axial direction, FIG. 3 is a plane view showing the constitution of an inner portion by removing a drive side bracket, FIG. 4 is a plane view showing the constitution of the inner portion by removing a rear bracket and FIG. 5 is a sectional view showing the constitution of a hydraulic pressure control valve portion in which the same notations are attached to constituent elements the same as those in the conventional example.

In FIG. 1 through FIG. 5, numeral 15 designates a drive side bracket, numeral 16 designates a rear bracket and numeral 17 designates a casing, which constitute a pressure vessel 18 in combination. Numeral 2 designates an output shaft rotatably supported by the drive side bracket 15 and the rear bracket 16. A connection member 19 for connecting to a cam shaft of an internal combustion engine, not illustrated, is attached to the drive side of the output shaft 2 and a rotational angle sensor 20 for detecting the rotational angle of the output shaft 2 is attached to the opposite side thereof. Numeral 3 designates a rotor constituted integrally with the rotational shaft 2 in the pressure vessel 18, a partition vane 4 is installed to the rotor 3, the partition vane 4 is constituted to pivot abrasively on the both side faces and the inner peripheral face of the pressure vessel 18 and divides the inside of the pressure vessel 18 into a first pressure chamber 21 and a second pressure chamber 22.

Numeral 23 designates a hydraulic pressure control valve attached to the casing 17 in a substantially radius direction. As shown by FIG. 5, the hydraulic pressure control valve 23 controls the hydraulic pressure in respect of the respective pressure chambers 21 and 22 by a spool 24, suction and exhaust hydraulic ports 25 and 26 and drain ports 27 and 28 which are perforated in the axial direction at a thick wall portion of the casing 17 and a supply port 29 receiving the hydraulic pressure from a hydraulic pump. Further, as shown by FIG. 3, the suction and exhaust hydraulic ports 25 and 26 are opened at a face of one bracket in contact with the casing and communicate with the first pressure chamber 21 and the second pressure chamber 22 via groove-like hydraulic pressure supply paths 30 and 31 which are installed in the casing 17. As shown by FIG. 4, the drain ports 27 and 28 are opened at a face of the other bracket in contact with the casing and communicate with each other by a groove-like drain path 32 which is installed in the casing 17 and the drain path 32 communicates with an oil tank, not illustrated. Incidentally, numeral 33 designates a spring elastically supporting the spool 24 and maintaining a balance with a pressing force of the hydraulic pressure control valve 23 and numeral 34 designates a screw for adjusting the amount of force of the spring 33.

According to the rotary hydraulic actuator in Embodiment 1 of the present invention, when the spool 24 is moved by operating the hydraulic pressure control valve 23 and the supply port 29 communicates with the suction and exhaust hydraulic port 25 as shown by FIG. 5, the suction and exhaust hydraulic port 26 communicates with the drain port 28. The hydraulic pressure supplied to the supply port 29 is supplied to the first hydraulic chamber 21 from the suction and exhaust hydraulic port 25 via the hydraulic pressure supply path 30 and the oil in the second pressure chamber 22 is exhausted from the drain port 28 via the hydraulic pressure supply path 31 and the suction and exhaust hydraulic port 26. As a result, in FIG. 3 the partition vane and the output shaft 2 are rotated in the clockwise direction thereby driving the cam shaft of an internal combustion engine. Further, when the spool 24 is moved further in the left direction in FIG. 5 and the supply port 29 communicates with the suction and exhaust hydraulic port 26, the suction and exhaust hydraulic port 25 communicates with the drain port 27 whereby the partition vane 4 and the output shaft 2 are driven in the anti-clockwise direction. Also, when the rotational position of the output shaft 2 is detected by the rotational angle sensor 20 and is fed back to a control device, not illustrated, and the output shaft 2 is detected to be at a predetermined position, the spool moves to an intermediate position and the communication among the respective ports is closed and the hydraulic pressure in respect of the first pressure chamber 21 and the second pressure chamber 22 is made uniform whereby the position of the output shaft 2 is maintained. Also, when the output shaft 2 is reversely driven by the rotational force from the cam shaft and the position of the output shaft 2 is varied, the rotational angle sensor 20 detects the variation and operates the hydraulic pressure control valve 23 whereby the predetermined position outputted from the control device is always maintained.

As described above, according to Embodiment 1 of the present invention, the hydraulic pressure control valve 23 is attached to the casing 17 in substantially a radius direction, the hydraulic pressure control valve 23 includes only the electromagnetic solenoid portion for driving the valve mechanism and the valve mechanism is installed to the thick wall portion of the casing 17 and the hydraulic pressure flow paths are installed to the both end faces of the casing 17. Therefore, even if the hydraulic pressure control unit is integrated to the actuator unit, the actuator unit is not enlarged and the hydraulic pipings can also be simplified by which the rotary hydraulic actuator having extremely excellent mountability can be constituted. Further, the rotational angle sensor 20 can be attached to the one end of the output shaft 2 and all the mechanisms can be integrated whereby the mountability can further be promoted.

EMBODIMENT 2

Figure 6:
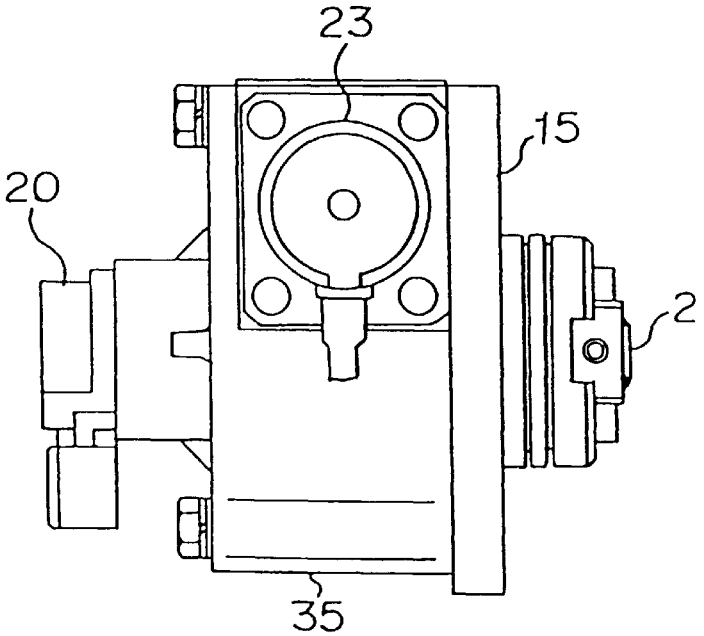
FIG. 6 is a side view of a second embodiment of the present invention.
Figure 7:
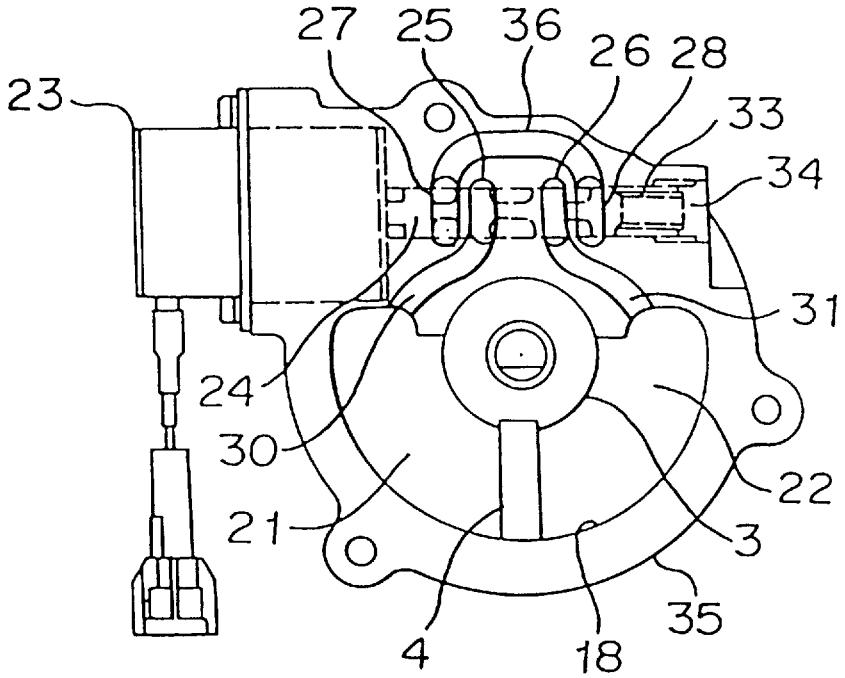
FIG. 7 is a plane view showing an inner portion of the second embodiment of the present invention.

FIG. 6 and FIG. 7 illustrate the constitution of Embodiment 2 of the present invention where FIG. 6 is a side view thereof and FIG. 7 is a plane view where a bracket is removed. According to this embodiment a casing 35 is formed in a cabinet shape along with a bracket and a pressure chamber 18 is constituted by two parts of the casing 35 and a drive side bracket 15. All of suction and exhaust hydraulic ports 25 and 26 and drain ports 27 and 28 perforated in the casing 35 are opened at a face of the drive side bracket 15 in contact with the casing 35. The suction and exhaust hydraulic ports 25 and 26 communicate with the first pressure chamber 21 and the second pressure chamber 22 via groove-like hydraulic pressure supply ports 30 and 31 and the drain ports 27 and 28 communicate with each other via a drain path 36 installed on the same plane along with the hydraulic pressure supply paths 30 and 31. The valve mechanism other than above-described and the like are provided with the constitutions similar to those in Embodiment 1.

According to the rotary hydraulic actuator of Embodiment 2 constituted as described above, the operation and effect similar to those of the rotary hydraulic actuator in Embodiment 1 are provided and further, the pressure chamber 18 is constituted only by the two parts of the casing 35 and the bracket 15 whereby the number of parts can be reduced and the productivity can be improved.

EMBODIMENT 3

Figure 8:
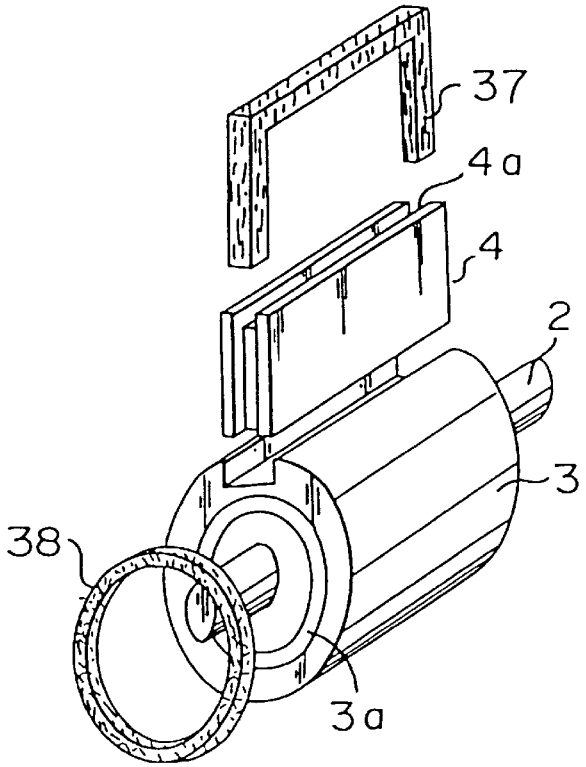
FIG. 8 is an explanatory view showing the constitution of a third embodiment of the present invention.

FIG. 8 is an explanatory view showing the constitution of Embodiment 3 of the present invention. In FIG. 8, numeral 2 designates an output shaft having a rotor 3, and numeral 4 designates a partition vane installed integrally to the rotor 3. A groove 4*a* is provided in the partition vane 4 and the groove 4*a* is mounted with a seal member 37 that is brought into press contact with the inner periphery and the inner faces on the both sides of the pressure vessel 18 shown in Embodiment 1 and is moved abrasively on those faces. According to the seal member 37, for example, a Teflon group resin is impregnated to a member in a netted string shape having a low friction coefficient such as aramid fiber, Teflon fiber, carbon fiber or the like. Also, annular grooves 3*a* are provided on both side faces of the rotor 3 and seal members 38 in a ring-like shape made of a similar material are fitted in the grooves.

According to the rotary hydraulic actuator in accordance with Embodiment 3 constituted as described above, even if the seal member 37 and the inner faces of the pressure vessel 18 are brought into press contact with each other by which oil leakage between the first pressure chamber 21 and the second pressure chamber 22 illustrated by FIG. 3 is restrained, the abrasive resistance between the partition vane 4 and the inner faces of the pressure vessel 18 can be maintained at a low value and both of the losses of oil leakage and abrasive resistance can simultaneously be improved whereby the rotary hydraulic actuator excellent in drive force and response can be constituted. Incidentally, the seal members 38 are installed to promote seal performance in respect of bearing portions and the seal performance can be secured without increasing the frictional resistance as in the seal member 37.

EMBODIMENT 4

Figure 9:
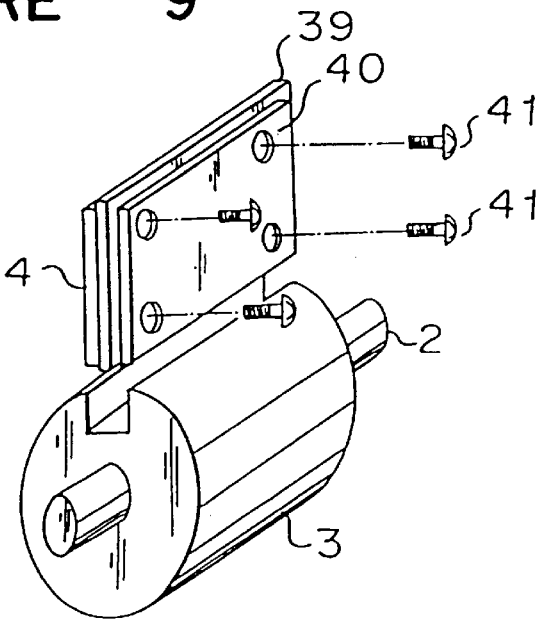
FIG. 9 is an explanatory view showing the constitution of a fourth embodiment of the present invention.

FIG. 9 illustrates the constitution of Embodiment 4 of the present invention and the object of Embodiment 4 is the promotion of seal performance between the pressure chambers and the reduction in abrasive resistance similar to that in Embodiment 3. According to Embodiment 4, the partition vane 4 is constituted by a seat 39 in which, for example, aramid fiber, Teflon fiber, carbon fiber or the like is formed in a plate-like shape and impregnated with a Teflon group resin and hard fixing plates 40 for holding and fixing the seat 39 and both of them are integrated by screws 41 or the like and attached to the rotor 3. The seal 39 is moved abrasively on the inner faces of the pressure chamber 18 in contact therewith and the abrasive resistance can be lowered even if both of them are brought into press contact with each other by which the rotary hydraulic actuator which is excellent in drive force and response can be provided.

EMBODIMENT 5

Figure 10:
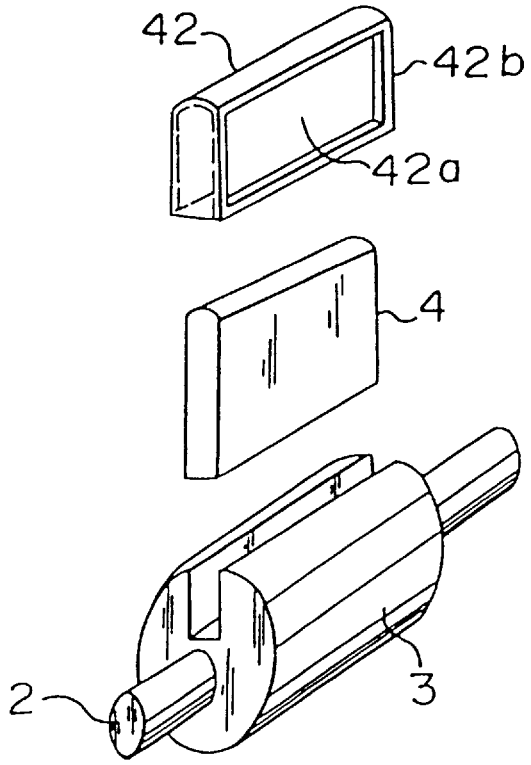
FIG. 10 is an explanatory view showing the constitution of a fifth embodiment of the present invention.
Figure 11:
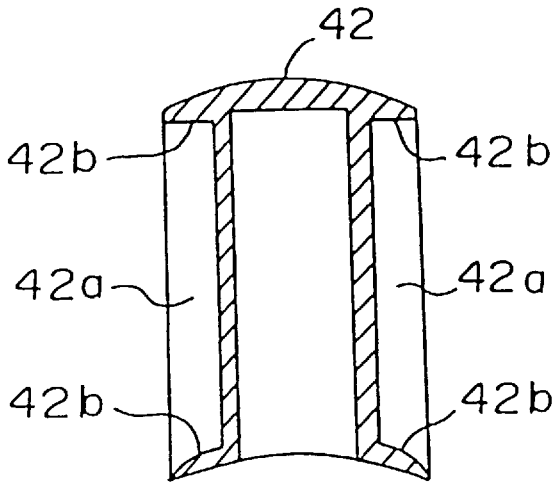
FIG. 11 is a sectional view showing the shape of a seal member according to the fifth embodiment of the present invention.

FIG. 10 and FIG. 11 illustrate the constitution of Embodiment 5 of the present invention where FIG. 10 is an explanatory view showing the constitution and FIG. 11 is a sectional view of a seal member. According to Embodiment 5, a partition vane 4 attached to the rotor 3 is covered with a seal member 42 in a bag-like shape formed by fluorinated rubber or a Teflon group resin and the abrasive movement of the partition vane in respect of the inner faces of the pressure vessel 18 is carried out on outer faces of the seal member 42. Further, skirt-like projected portions 42*b* projecting toward the pressure chambers are provided at the surrounding of both side faces 42*a* of the bag-like seal member 42, that is, corner portions of both side faces which are moved abrasively on the inner faces of the pressure vessel 18 in contact therewith and portions of the seal member 42 in contact with the rotor 3.

According to Embodiment 5 constituted as described above, similar to Embodiment 3, the loss of the drive torque is small since the abrasively moving portions are made of a member having a low friction coefficient. Further, when oil leakage occurs between the seal member 42 and the inner faces of the pressure vessel 18, the skirt-like projected portions 42*b* are pressed onto the inner face of the pressure vessel 18 owing to the pressure difference by which high sealing performance can be achieved. Oil leakage can similarly be prevented also between the seal member 42 and the rotor 3 whereby the rotary actuator which is excellent in drive force and response can be provided.

EMBODIMENT 6

Figure 12:
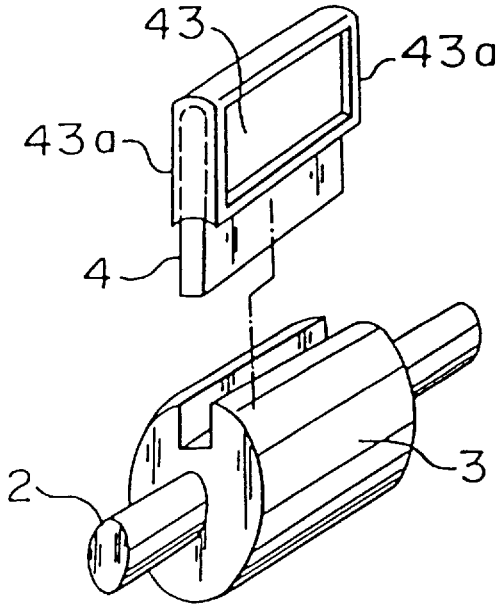
FIG. 12 is an explanatory view showing the constitution of a sixth embodiment of the present invention.
Figure 13:
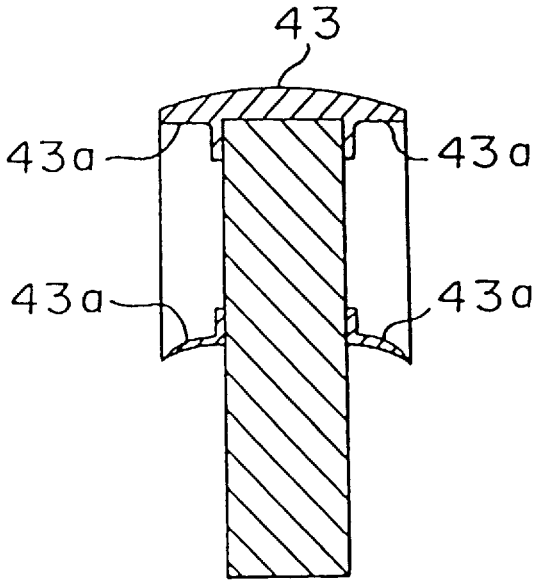
FIG. 13 is a sectional view showing the shape of a seal member according to the sixth embodiment of the present invention.

FIG. 12 and FIG. 13 illustrate the constitution of Embodiment 6 of the present invention where FIG. 12 is an explanatory view showing the constitution and FIG. 13 is a sectional view of a partition plate. According to Embodiment 6, a seal member 43 made of fluorinated rubber or a Teflon groove resin is molded with a partition vane 4 as an insert material. The seal member 43 at least covers the abrasively moving portion of the partition vane 4 in respect of the inner faces of the pressure vessel 18. As illustrated in FIG. 13, skirt-like projected portions 43*a* projecting toward the pressure chambers are provided at corner portions formed by the side faces and abrasively moving faces of the seal member 43 in contact therewith, and at portions of the seal member 43 in contact with the rotor 3. Also in this embodiment, similar to Embodiment 5, the promotion of drive force and response is achieved by reducing the abrasive resistance and reducing oil leakage.

EMBODIMENT 7

Figure 14:
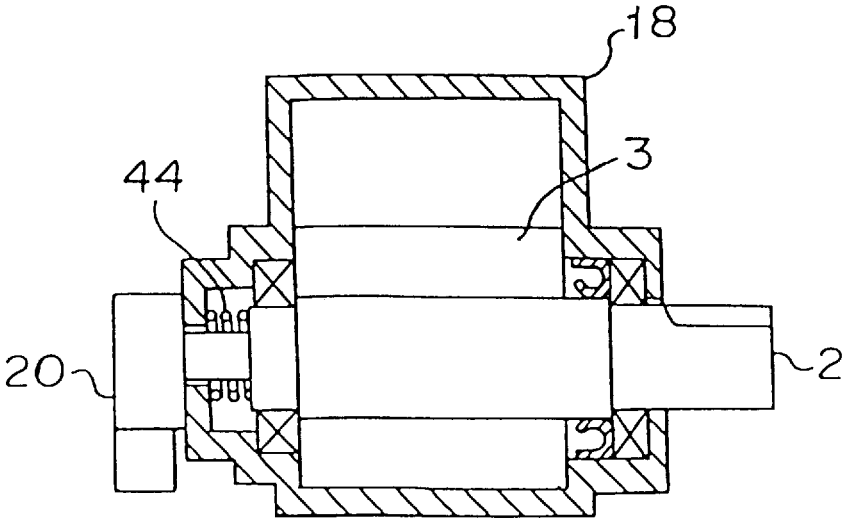
FIG. 14 is a sectional view showing the constitution of a seventh embodiment of the present invention.
Figure 15:
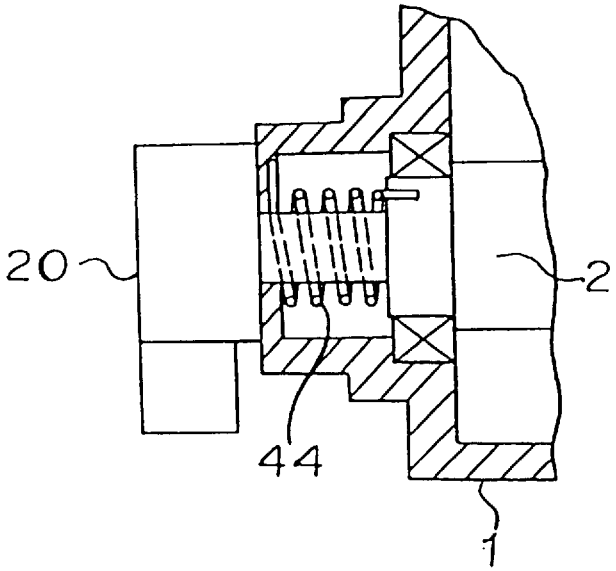
FIG. 15 is a partially magnified sectional view of the seventh embodiment of the present invention.

FIG. 14 is a sectional view showing the constitution of Embodiment 7 and FIG. 15 is a partially magnified sectional view thereof. In FIG. 14 and FIG. 15, numeral 18 designates a pressure vessel, numeral 2 designates an output shaft having a rotor 3, numeral 20 designates a rotational angle sensor and numeral 44 designates a spring installed between the pressure vessel 18 that is a fixed member and the output shaft 2. The spring 44 is constituted such that the torsional stress thereof presses the output shaft 2 to the side of the initial position. According to the rotary hydraulic actuator constituted as described above, even if the hydraulic pressure in the pressure chambers is lowered in non-operating the valve, deviation of the output shaft 2 from the initial position due to external causes such as vibration or the like can be prevented and the positional accuracy in reusing the valve can be secured.

EMBODIMENT 8

Figure 16:
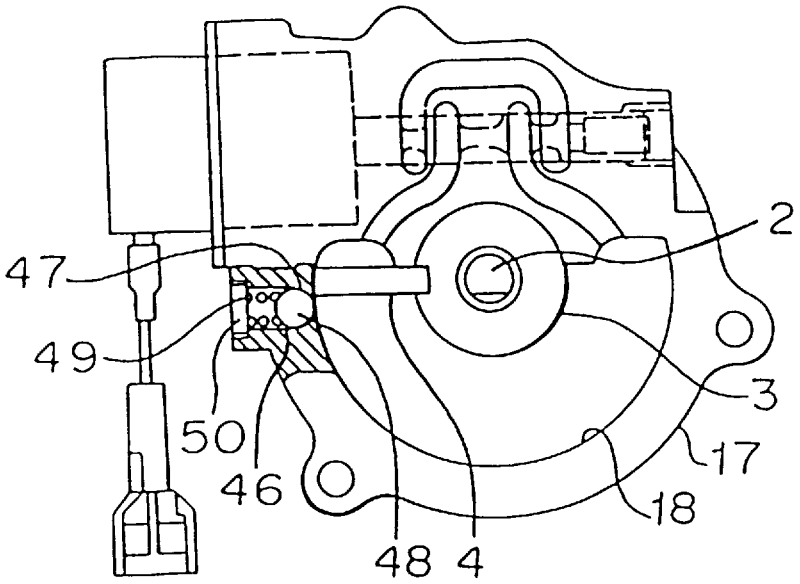
FIG. 16 is a partially cut sectional plane view showing the constitution of an eighth embodiment of the present invention.

FIG. 16 illustrates the constitution of Embodiment 8 of the present invention and is a partially cut plane view showing a state where the bracket of the rotary hydraulic actuator is removed. In FIG. 16, numeral 2 designates an output shaft, numeral 3 designates a rotor, numeral 4 designates a partition vane, and numeral 17 designates a casing. A hole 46 is provided in the casing 17 in the direction from outside toward the pressure vessel 18 and a small diameter portion 47 is constituted at a portion of the hole 46 penetrated to the pressure vessel 18. A ball 48 as a stopper inserted into the hole 46 and a pressing force is applied toward the inner side of the pressure vessel 18 by a adjusting screw 50 via a spring 49 whereby the adjusting screw 50 maintains air tightness in the pressure vessel 18. Further, a portion of the front end of the ball 48 is projected into the pressure vessel 18.

According to the rotary hydraulic actuator in accordance with Embodiment 8 constituted as described above, after the operation is finished, the output shaft 2 is pivoted to the initial position, that is, when the output shaft 2 returns to the finish end of one pivoting direction and when the valve is operated again, the partition vane 4 is pivoted by pushing up the ball 48 by the rotational force caused by the hydraulic pressure, the position of the partition vane 4 is maintained by the projection of the ball 48 at the initial position and even if the hydraulic pressure is lowered, the initial position is not moved by external factors such as vibration etc. Incidentally, the maintaining force of initial position and the response in starting the operation can be adjusted by the adjusting screw 50.

EMBODIMENT 9

Figure 17:
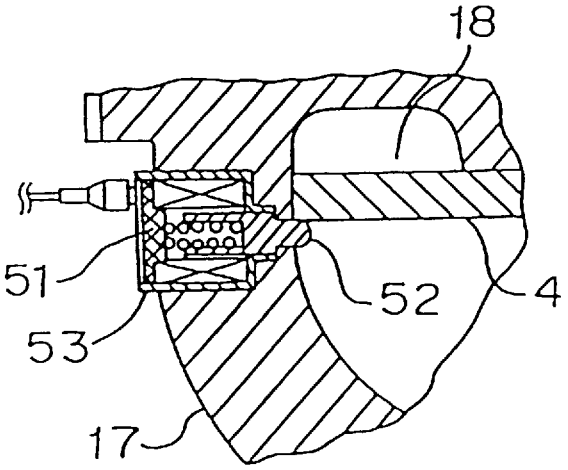
FIG. 17 is a sectional view showing the constitution of a ninth embodiment of the present invention.
Figure 18:
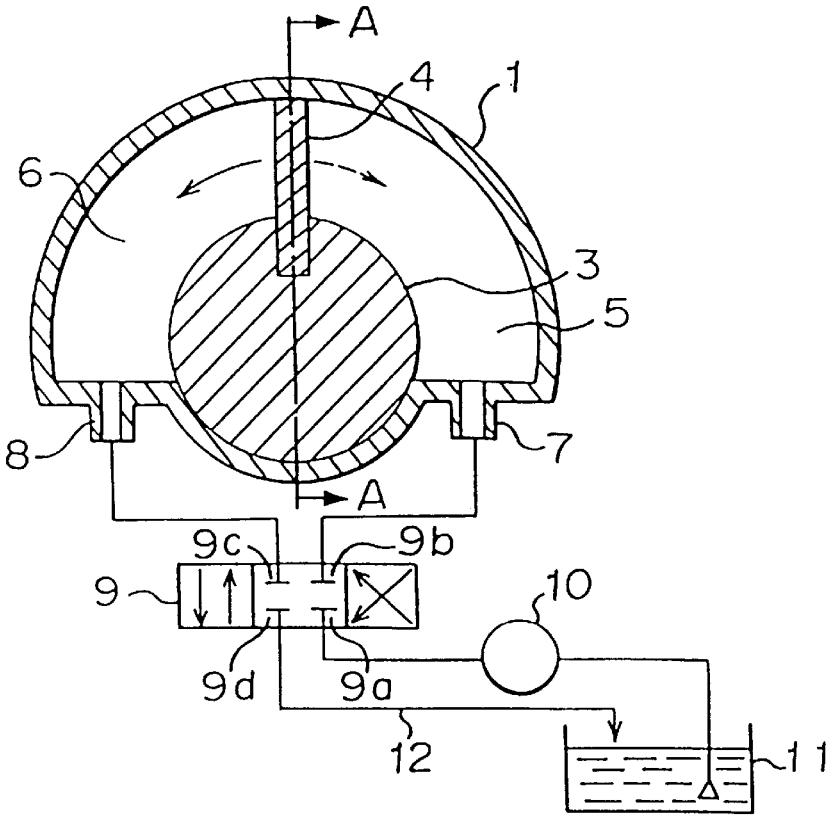
FIG. 18 is an explanatory view showing the constitution of a conventional rotary hydraulic actuator.
Figure 19:
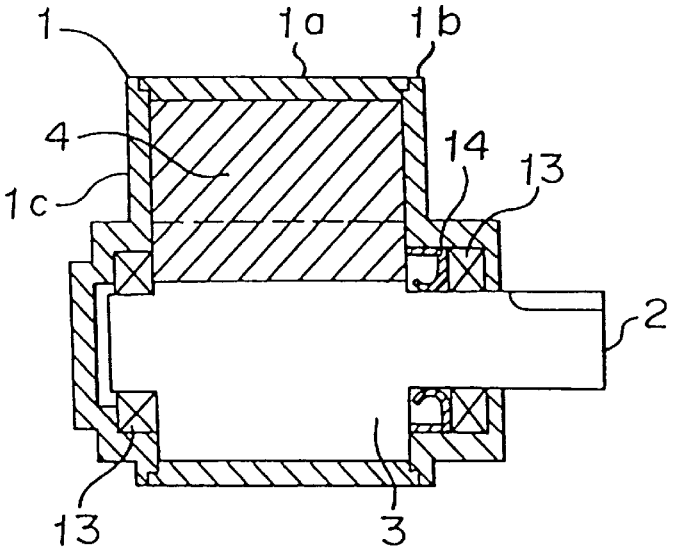
FIG. 19 is an explanatory view showing the constitution of the conventional rotary hydraulic actuator.

FIG. 17 is a sectional view showing the constitution of Embodiment 9 of the present invention. In FIG. 17, numeral 51 designates an electromagnetic solenoid attached to the casing 17. The front end of a stopper 52 constituting a movable piece of the electromagnetic solenoid 51 is projected into the pressure vessel 18 by a spring 53 in a nonexcited state whereby the partition vane 4 is fixed to the initial position. When the electromagnetic solenoid 51 is excited by flowing current, the stopper 52 is retracted from the inside of the pressure vessel 18 by which the partition vane 4 is released from the binding force.

According to the rotary hydraulic actuator constituted as described above, when it is detected that the hydraulic pressure control valve 23 is not operating and the output shaft 2 is at the initial position by a control device, not illustrated, and the rotational angle sensor 20 described in Embodiment 1, the control device stops flowing current to the electromagnetic solenoid 51 and current is made to flow to the electromagnetic solenoid 51 simultaneously with the starting of operation by which the partition vane 4 can be maintained at the initial position and stably operated.

As described above, according to the rotary hydraulic actuator of the present invention, the hydraulic control valve is attached to the casing of the actuator in substantially a radius direction and the valve mechanism and the hydraulic pipings are constituted in the casing by which the rotary hydraulic actuator including the hydraulic pressure control valve can be downsized.

Further, the rotary hydraulic actuator which is small-sized and is provided with excellent mountability and where the rotational angle sensor can be mounted to one end of the output shaft can be provided.

Further, the abrasive resistance can be reduced while promoting the sealing performance in respect of the hydraulic pressure between the rotating unit and the fixed unit and accordingly, the rotary hydraulic actuator which is small-sized, and provided with large drive force and good response can be provided.

Also, there is provided the rotary hydraulic actuator capable of operating stably where even if the hydraulic pressure in the pressure chambers is lowered in non-operating of the valve, the output shaft is not moved by external causes such as vibration or the like and the initial position in restarting can be secured.

What is claimed is:

1. A rotary hydraulic actuator comprising:

a sealed vessel comprising brackets and a casing;

a partition vane attached to a shaft supported by the brackets for dividing an inside of the sealed vessel into a first pressure chamber and a second pressure chamber and pivoting the shaft by a pressure difference between the first and the second pressure chambers;

suction and exhaust hydraulic ports and a drain port installed to the casing;

a hydraulic control valve mounted to the casing for conducting a hydraulic control along with the suction and exhaust hydraulic ports and the drain port;

groove-like hydraulic pressure supply paths installed to a face of one of the brackets in contact with the casing for communicating the first pressure chamber and the second pressure chamber respectively to the suction and exhaust hydraulic ports; and a groove-like drain path installed to a face of another one of the brackets in contact with the casing for communicating to the drain port.

2. The rotary hydraulic actuator according to claim 1, wherein a load is connected to one end portion of the shaft and a rotational position detecting sensor is installed to another end portion.

3. The rotary hydraulic actuator according to claim 1, wherein the hydraulic supply paths and the drain path are separately installed to different ones of the faces of the brackets in contact with the casing.

4. The rotary hydraulic actuator according to claim 1, wherein both of the hydraulic pressure supply paths and the drain path are installed to one of the faces of the brackets in contact with the casing.

5. The rotary hydraulic actuator according to claim 1, wherein the partition vane is provided with a groove installed to an abrasive movement face thereof in respect of an inner face of the sealed vessel and a seal member in a netted string shape impregnated with a Teflon group resin is mounted onto the groove.

6. The rotary hydraulic actuator according to claim 1, wherein the partition valve is provided with an abrasive movement portion in respect of an inner face of the sealed vessel comprising a seal member impregnated with a Teflon group resin and hard fixed plates pinching the abrasive movement portion from side faces thereof.

7. The rotary hydraulic actuator according to claim 1, wherein the partition vane is provided with an abrasive movement portion in respect of an inner face of the sealed vessel covered by a seal member in a bag-like shape formed by fluorinated rubber or a Teflon group resin.

8. The rotary hydraulic actuator according to claim 1, wherein the partition vane is provided with an abrasive movement face in respect of an inner face of the sealed vessel covered by fluorinated rubber or a Teflon group resin by an insert molding of a main body of the partition vane.

9. The rotary hydraulic actuator according to claim 7, wherein the partition vane is provided with protruded portions in a skirt-like shape made of fluorinated rubber or a Teflon group resin which are protruded from both side corner portions of the abrasive movement face in respect of the inner face of the sealed vessel into the first and the second pressure chambers.

10. The rotary hydraulic actuator according to claim 8, wherein the partition vane is provided with protruded portions in a skirt-like shape made of fluorinated rubber or a Teflon group resin which are protruded from both side corner portions of the abrasive movement face in respect of the inner face of the sealed vessel into the first and the second pressure chambers.

11. The rotary hydraulic actuator according to claim 1, wherein the partition vane is held at an initial position by a ball stopper installed to a fixed portion.

12. The rotary hydraulic actuator according to claim 1, wherein a motion of the partition vane is regulated by a lock mechanism operating in correspondence with an operational state of the hydraulic control valve.

13. The rotary hydraulic actuator according to claim 1, wherein the shaft is provided with a rotational position restoring mechanism having a spring-like member.

* * * * *